US005335790A

United States Patent [19]

Geiger et al.

[11] Patent Number: 5,335,790

[45] Date of Patent: Aug. 9, 1994

[54] METHOD AND DEVICE FOR SEPARATING PIECES OF WOOD

[75] Inventors: Bertram Geiger; Rainer Grabher, both of Graz, Austria

[73] Assignee: Andritz-Pantentverwaltungs-Gesellschaft M.B.H., Graz, Austria

[21] Appl. No.: 833,847

[22] Filed: Feb. 10, 1992

[30] Foreign Application Priority Data

Feb. 8, 1991 [AT] Austria ..... 275

[51] Int. Cl.[5] ..... B07C 5/14; B07C 5/342

[52] U.S. Cl. ..... 209/518; 209/581; 209/587; 209/656; 209/939; 144/340; 356/237; 348/125

[58] Field of Search ..... 209/517, 518, 580, 581, 209/582, 912, 559, 564, 587, 656, 657, 939; 356/237, 240; 358/101, 106, 107; 250/223 R, 223 B, 271; 144/208, 340, 356

[56] References Cited

U.S. PATENT DOCUMENTS

| | | | |
|---|---|---|---|
| 3,456,700 | 7/1969 | Ahlstedt | 209/518 X |
| 3,642,041 | 2/1972 | Hamilton et al. | 144/340 X |
| 3,812,965 | 5/1974 | Kurata et al. | 209/518 |
| 4,185,672 | 1/1980 | Vit et al. | 209/518 X |
| 4,679,075 | 7/1987 | Williams et al. | 358/106 |
| 4,924,088 | 5/1990 | Carman et al. | 209/580 X |
| 4,992,949 | 2/1991 | Arden | 356/237 X |

FOREIGN PATENT DOCUMENTS

| | | | |
|---|---|---|---|
| 3039979 | 4/1982 | Fed. Rep. of Germany . | |
| 3211344 | 10/1982 | Fed. Rep. of Germany | 209/518 |
| 3910378 | 4/1990 | Fed. Rep. of Germany . | |

*Primary Examiner*—D. Glenn Dayoan
*Assistant Examiner*—Tuan N. Nguyen
*Attorney, Agent, or Firm*—Roylance, Abrams, Berdo & Goodman

[57] ABSTRACT

A method and apparatus for separating pieces of wood into different qualities in a wood sorting process is characterized in that the brightness as well as the texture of the surface of the wood are measured, and the pieces of wood are separated into different quality groups according to the measurements results obtained.

15 Claims, 5 Drawing Sheets

METHOD AND DEVICE FOR SEPARATING PIECES OF WOOD

FIELD OF THE INVENTION

The invention relates to a method and a device for carrying out the method for classifying and separating pieces of wood into different qualities in a wood sorting process.

BACKGROUND OF THE INVENTION

Subsequent processing of pieces of wood following the bark peeling device require the wood to have a certain quality. For this purpose the pieces of wood are examined as to the degree of unbarking, dimensions, shape, possibly insufficient disbranching and wood quality (impaired e.g. by rotting, pests, damage done by game). Depending on the design of the installation, the inspected logs are at present divided into two material streams (wood - bark) or three material streams (wood - bark - discard). Mechanical sorting is complicated, since determining and measuring bark content in a mass flow of wood is extremely difficult. Mechanical recognition of different wood qualities is further complicated by the similar appearance of dark wood, insufficiently peeled wood and bad wood (rotting, pests, etc.). Mechanical recognition of the quality of wood is also difficult since the pieces of wood are usually arranged on a constantly moving conveyor and the pieces of wood are often overlying each other or stacked upon each other within one observation zone.

All the above circumstances render mechanical separation of the pieces of wood into different qualities difficult, and therefore sorting out has ordinarily continued to be done manually. Capacity increases are achieved by having the pieces of wood visually examined by an operator and accordingly selectively actuating gates, for example, electromagnetically operated gates, to divert the wood to an appropriate station or work zone. Because of human shortcomings and because of subjective decisions of the operating personnel, it may thus happen that insufficiently peeled pieces of wood or unfit pieces of wood are not eliminated from the processing system which may adversely affect the quality or operation of the resulting product.

Methods attempting to separate pieces of wood according to their bark content are known. This is typically done by heating the pieces of wood and measuring the infrared radiation of the material. This method has the disadvantage in that apart from a relatively high energy consumption, the intake of heat by the pieces of wood is also influenced by many other factors as, e.g., moisture, type of wood, etc., thus making it impossible to draw exact conclusions as to the degree of unbarking. Moreover, it is only possible to distinguish at most two different categories (wood - bark). It is not generally possible to determine the type of wood, physical defects in the wood, shape or dimension.

SUMMARY OF THE INVENTION

Thus, the invention has the objective to avoid the aforesaid disadvantages and to provide an automatic method for separating the pieces of wood into different qualities. As used herein, the term wood is intended to be used generically to encompass whole logs, cut lumber or timber.

The method is characterized in that the brightness and the structure or texture of the wood surface are measured and the pieces of wood are divided up into different quality groups on the basis of the measurement results.

The method has the advantage of being readily adaptable to an existing installation without significant redesign of the apparatus. It further has the advantage of high capacity and good reliability.

A preferred form of the apparatus and method according to the invention eliminates badly peeled wood from the bark removing process in an especially economic way. By measuring the brightness and structure of the wood surface it is easily possible to distinguish and separate dark, good wood from insufficiently peeled wood and to determine the amount of bark remaining on the wood. The apparatus is further able to determine structural defects in the wood, such as splits, the presence of branches or limbs, rot, and insect damage.

A further development of the invention is characterized in that pieces of wood unsuitable for the subsequent process (secunda) are eliminated from the conveyor. By this elimination of undesirable wood, it is possible to return the insufficiently peeled wood to the bark removing apparatus, such as a peeling drum, thus considerably increasing the yield of the process and the economic efficiency of the process.

It is especially favorable to measure the brightness of the wood using vertical illumination. In a preferred form of the invention, the wood pieces are illuminated by a light source positioned directly overhead such that the illumination source directs light downwardly perpendicular to the conveyor. This has the advantage that the measuring process is not sensitive to dirt and that no major changes in construction of existing semiautomatic sorting stations are necessary.

Considerable enhancement of precision is achieved by repeatedly determining or assessing a mean measuring field on a piece of wood rolling by and obtaining a plurality of measurements of the brightness of different measuring fields on the wood. The measurements obtained in the measuring fields are used for comparison with known, predetermined values for determining the quality of the wood. By assessing a plurality of measurements in a number of measuring fields, undesirable marginal influences can be avoided. The ends of logs are often split or damaged and produce brightness measures which are not an indication of the quality of the entire piece of wood. By multiple assessment and measurement on the rolling log, at least a major part of the wood surface is taken into consideration.

An appropriate development of the method is characterized in that in analyzing the measuring results obtained, logs contacting each other are recognized and thus the individual data separated. With this development of the invention, it is possible to evaluate the individual pieces of wood separately even if the conveying belt carriers are occupied by several pieces at once.

It is desirable to compensate for different lighting intensities across the measuring field. Preferably, the apparatus is calibrated before the wood pieces are measured. This can be done by measuring a calibrated plane on the conveyor when the installation is at a standstill and empty and accordingly taking into account these values when analyzing measurements.

It is also advantageous to assess the length, volume and shape of the pieces of wood and if necessary eliminate pieces of wood outside a predetermined limit as being unfit. By eliminating undesirable pieces of wood, e.g., heavily branched pieces of wood, heavily bent or warped pieces of wood or very thin logs, the subsequent process steps can be carried out much better, possibly leading to considerable savings of, e.g., chemicals or energy.

A favorable development of the method is achieved by using the measurement results for statistical purposes or for controlling parts of the installation either upstream or downstream of the brightness measuring zone. For example, measurements indicating large amounts of bark remaining on the pieces of wood can be used for controlling the preceding bark peeling drum. The results concerning number of pieces, length or volume offer additional information, making it possible to make assessments on throughput and possibly also on the quality of the wood supplied.

An advantageous development of the method is achieved by feeding the brightness measurement data into a data processing system, such as, e.g., a micro computer, for the purpose of producing and transmitting a control signal responsive to the brightness measurement to a sorting device. The control signal actuates the sorting device to direct all of the pieces of wood of a predetermined quality to a further zone for subsequent processing. The control signal further actuates to sorting device to direct undesirable pieces of wood to a waste zone or other zone for appropriate processing.

The invention also relates to a device for carrying out the aforesaid method comprising a feeding conveyor and a conveyor for receiving the pieces of wood from the feeding conveyor and carrying one or more pieces of wood while lying transversely to the conveying direction in an intermediate carrier field or shovel space. The invention is characterized by at least one camera assessing the brightness of a measuring field of the pieces of wood and the roughness of the pieces of wood. Furthermore, a data processing unit, such as a micro computer is provided, processing data received from the camera and transmitting a control signal to a sorting device which directs the pieces of wood to one of at least two discharge conveyors in response to the data and the signal.

In a further embodiment of the invention, at least one additional camera with a different observation or measuring field is used to obtain a second brightness measurement. Such an arrangement is especially well suited for compensating for the shadows on the wood pieces resulting from incidental light. When using a camera with smaller measuring field but higher picture definition, in particular ,the roughness of the pieces of wood can be determined especially well.

A preferred embodiment of the invention is characterized in that a distance transmitter is included in the camera region to determine the distance between the camera and wood. By determining the distance between the camera and the pieces of wood, the diameter of the pieces of wood and possible overlapping of several pieces of wood can be determined.

It is favorable to provide at least one, preferably two lighting or illumination means for illuminating the measuring field on the pieces of wood. By illumination with special lighting means, unfavorable influences of the incidental light present in the surroundings may be largely ignored and become inconsequential in measuring the brightness. By directing the light source on the measuring field, differences in brightness are more pronounced, leading to better recognition and distinction of different pieces of wood. In particular, the case of two lighting means, shadows occurring and other irregularities can compensated for and usually avoided.

A further improvement of the device according to the invention is characterized in that the conveying surface and rolling surface in the region of the sorting station is covered with a black, wear-resistant plastics material. By providing a uniform, durable, and defined background, the differences in brightness between the pieces of wood are more prominent and unaffected by influences of the rolling surface caused by, e.g., uneven wear, dirt, etc.

BRIEF DESCRIPTION OF THE DRAWINGS

The invention is exemplified by the drawings of which the following is a brief description.

DETAILED DESCRIPTION OF THE INVENTION

Figure 1:
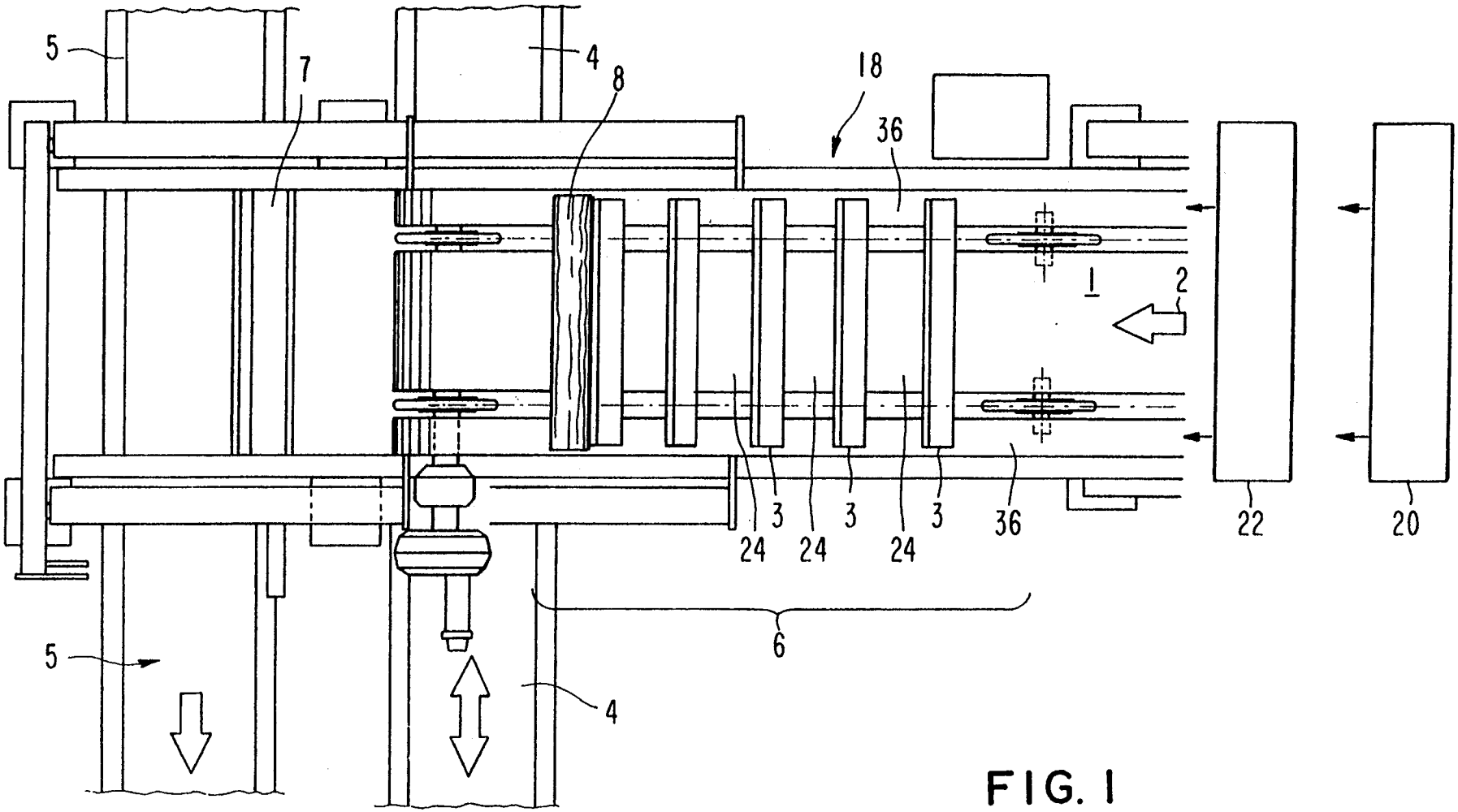
FIG. 1 is a plan view of a complete installation.

The invention is directed to a method and apparatus for classifying pieces of wood and in particular logs moving on a conveyor and directing the logs to a desired location. The apparatus is particularly adapted for classifying logs which have come from a conventional bark removing apparatus. The apparatus classifies the logs by measuring the brightness of the logs in a plurality of measuring fields on the logs and recording an image of the surface of the logs and determining the extent of the bark removal from the brightness measurement.

The apparatus in a preferred embodiment of the invention comprises a bark removing apparatus 20, a feed conveyor 22 for receiving logs from the bark removing apparatus, and a main conveyor 1 of a classifying and sorting apparatus 18. The conveyor 1 includes a plurality of spaced carriers or shovels 3 extending upward from the conveyor belt surface to push the logs and define a carrier field 24. The carriers 3 serve to separate the logs while being conveyed through a viewing zone 6. The logs are randomly deposited on the conveyor i so that the logs are positioned substantially transverse to the direction of travel of the conveyor 1. The conveyor 1 carries the logs through the apparatus 18 in the direction of arrow 2 shown in FIG. 1. The conveyor 1 is of the type to rotate the logs in a rolling manner as the logs are conveyed along the length of the conveyor by the carriers 3. In the embodiment shown in FIG. 1, the ends of the logs 8 ride on stationary outer rails 36 which causes the logs to roll as they are pushed by the carriers 3.

Figure 3:
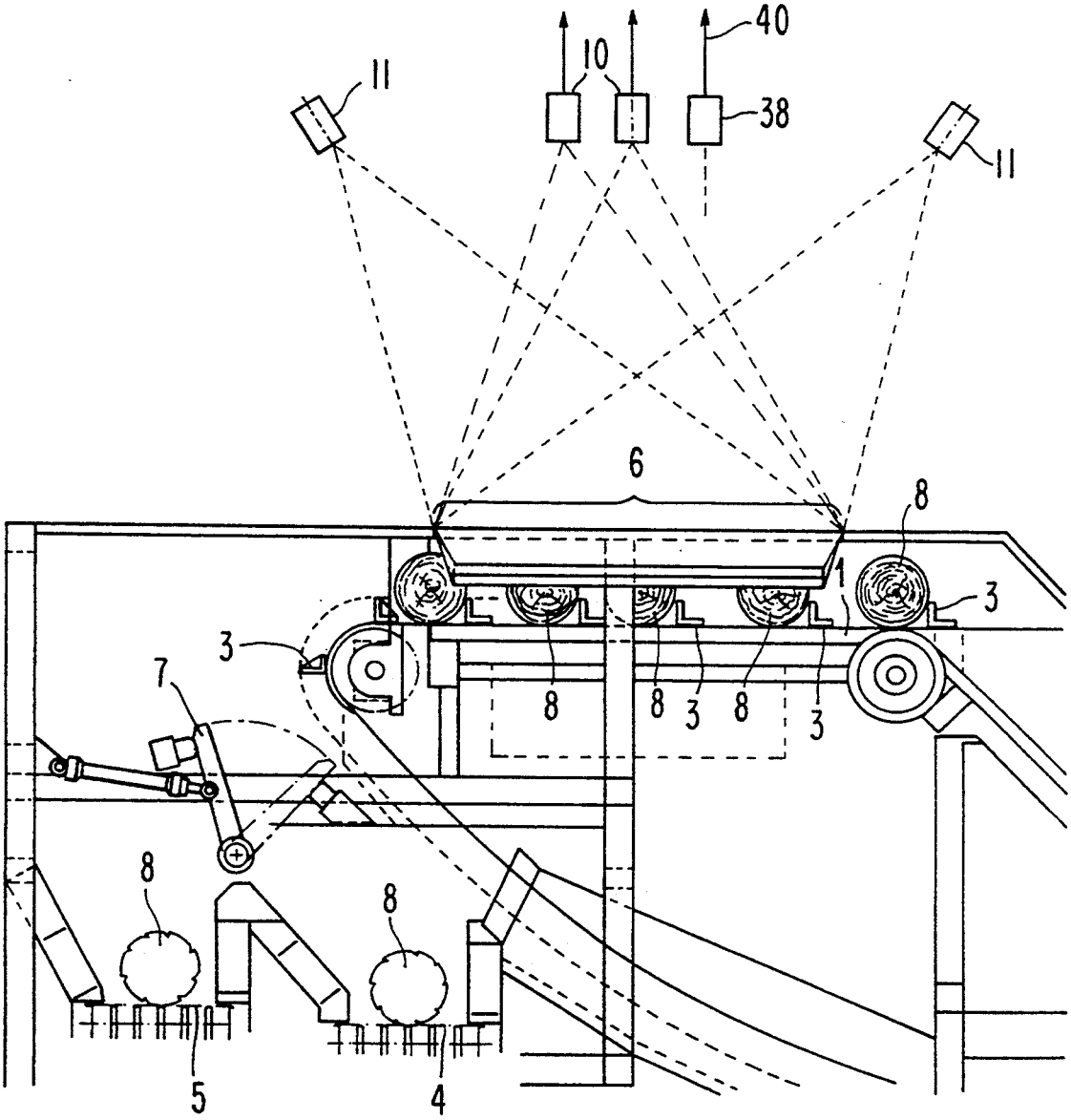
FIG. 3 represents a side view of the installation of FIGS. 1 and 2.

The logs 8 are conveyed through an observation or viewing zone 6 above the conveyor 1 while being rotated. A photometer or camera 10 and preferably at least one illuminating device 11 shown in FIG. 3 are positioned above the viewing zone 6 to illuminate the logs 8 and measure the brightness of the logs. The logs subsequently reach the discharge end of the conveyor belt 1 where the logs are discharged to one of two discharge conveyors 4 and 5. As shown in FIG. 1, two discharge conveyors are included in this embodiment, although more discharge conveyors may be provided.

The camera 10 measures the brightness in a plurality of viewing fields 12 on each of the logs as they are rotating to obtain a plurality of brightness measurements for each log. The camera 10 views the surface of the logs 8 in a plurality of viewing fields 12 which may be arranged around the periphery of the logs, along the longitudinal length of logs or a combination thereof. Preferably the viewing fields 12 are contiguous with one another. Alternatively, the viewing fields 12 may be spaced apart or overlap with each other. Preferably, the viewing fields 12 are slightly spaced from the ends of the logs since the ends are often split or damaged and result in brightness measurements which would not be an accurate representation of the major portions of the log.

Figure 2:
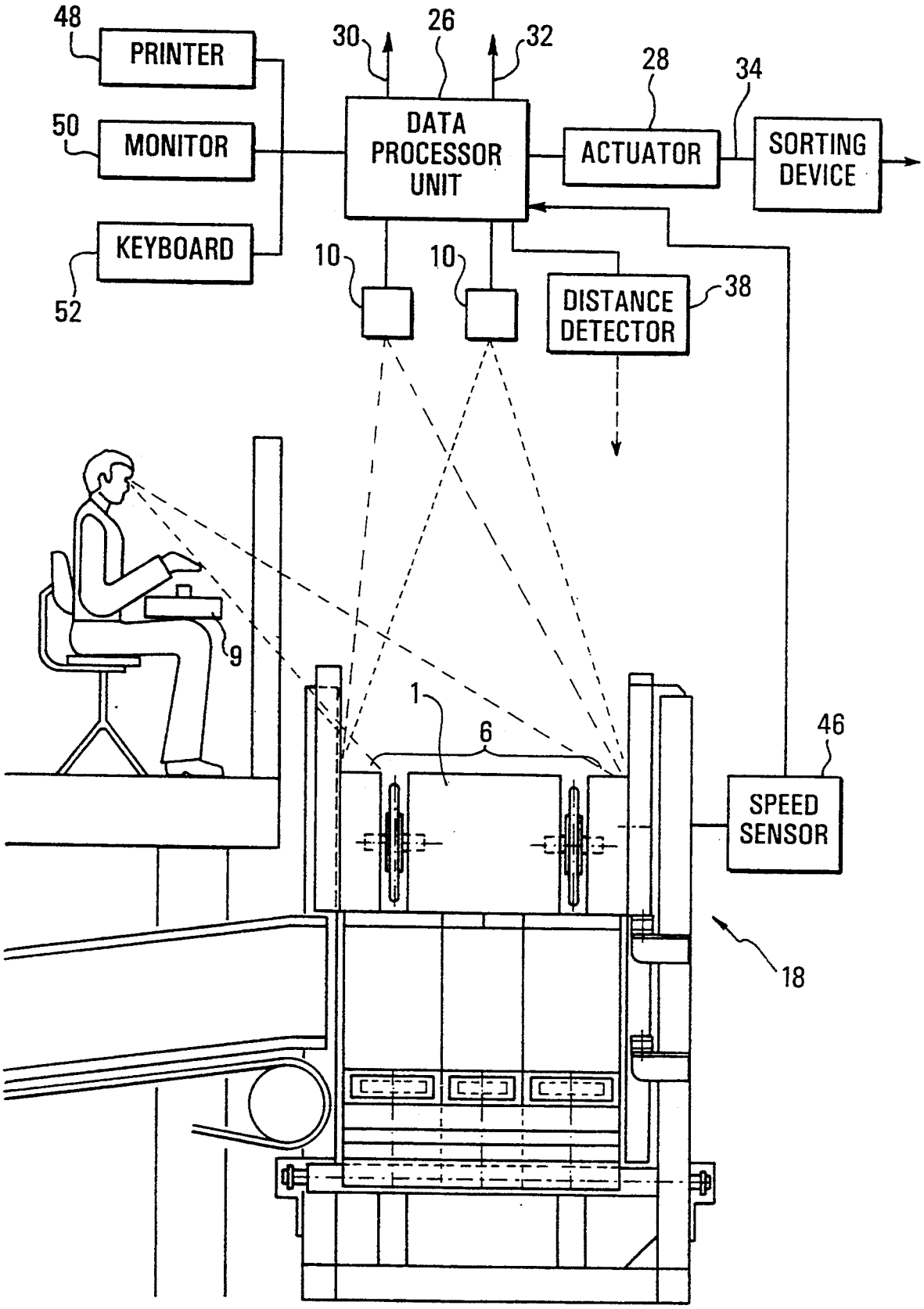
FIG. 2 shows the complete installation according to FIG. 1, seen from the side where discharge of the logs takes place.

The camera 10 views the logs passing along the conveyor, produces signals responsive to the brightness measurements for each measuring field 12 and transmits the signals to a data processing unit 26 such as for example, a micro-processor. The data processing unit 26 receives the signals from the camera 10 and calculates an average brightness value for each log by averaging each of the measurements corresponding to each log. Within the data processing unit 26 is a storage unit to store the data received from the camera 10. As shown in FIG. 2, the data processing unit is also connected to a printer 48, display monitor 50 and a keyboard 52 for entering and retrieving information from the data processing unit 26. A speed sensor 46 is also connected to the data processing unit 26.

The data processing unit 26 compares the calculated average brightness value with a known value to obtain a comparative value and produces a control signal in response to the comparison. The control signal is transmitted to an actuator 28 controlling the sorting apparatus to actuate the apparatus in response to the calculated average brightness value in the form of the control signal. The control signal is used to actuate the sorting apparatus to divert logs to a desired work station. For example, brightness measurements indicating an unacceptable amount of bark remaining on the log may be used to divert a log to a further bark removing apparatus. Alternatively, a brightness measurement indicating an acceptable log may be used to divert the log to a milling apparatus.

The data received from the camera 10 may also be transmitted to an upstream or a downstream apparatus indicated by lines 30 and 32, respectively, to adjust the apparatus in response to a brightness measurement. For example, an unacceptably large number of logs having excessive amounts of bark on the logs can be transmitted to the bark removing apparatus to adjust the apparatus to increase the bark removal.

The camera 10 as used in the invention is a conventional photometric brightness measuring device as known in the art. The illumination devices 11 are similarly conventional light sources to illuminate the viewing zone 6 and particularly the measuring fields 12 on the logs.

As used herein, the term brightness is intended to refer to the characteristic of the ability of the wood to reflect light. The camera 10 thus detects and records the amount of light reflected from the illumination source 11. Measuring the brightness of the wood has been found to be a good tool for determining defects in the surface of the wood and the amount of bark remaining on the log. For example, the bark of the logs is typically darker than the wood and has a dull, matte appearance and readily absorbs light with little reflectance. After the bark is removed to expose the wood, the logs typically have a higher reflectance of light. The camera 10 is able to measure and record the amount of reflected light or brightness of the logs as an indicator of the quality of the log and the extent of bark removal.

Figure 4B:
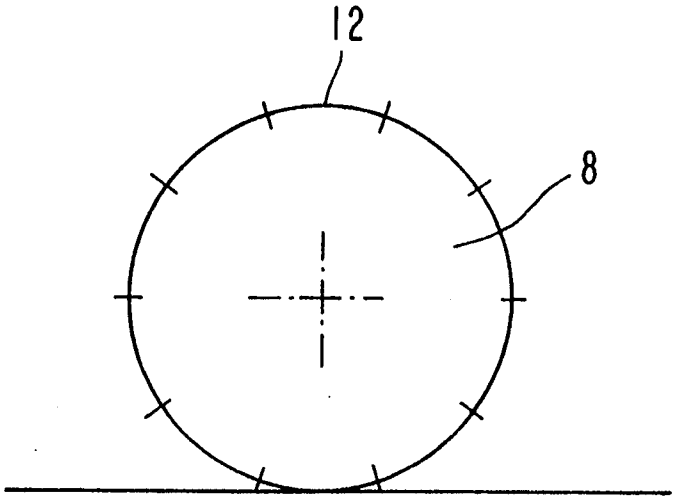
FIGS. 4*a* and 4*b* represent the definition of the measuring field, FIG. 4*a* being the division of the fields across the length of the log and FIG. 4*b* being the division of the fields of observation on the periphery of the log.
Figure 4A:
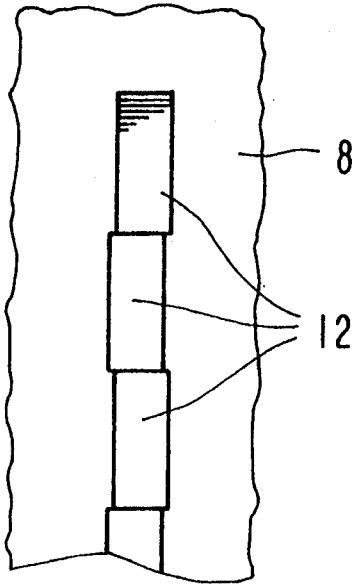

In a preferred embodiment of the invention, the camera 10 and the data processing unit 26 record the brightness of each viewing field 12 on the log 8 as the logs are conveyed through the observation zone 6 of the apparatus 18. The compilation of brightness measurements for each log are recorded to form a recorded image of each log. Preferably the logs 8 are rotated while being conveyed through the observation zone 6 so that the camera 10 is able to obtain a brightness measurement of each viewing field substantially around the entire periphery and along the length of the log. In this manner, the camera is able to obtain a brightness measurement for the entire surface area of each log as illustrated in FIGS. 4*a* and 4*b*.

The camera 10 may be a conventional photometer device capable of measuring the intensity of reflected light from the logs. The camera is positioned to view the logs and measure the brightness in a plurality of viewing fields 12 positioned along the longitudinal length and around the periphery of the logs. Camera 10 produces a signal corresponding to the measured brightness of each field and transmits the signals to the data processing unit 26. The data processing unit receives the signals for each viewing field 12 and calculates an average value for the fields aligned in the longitudinal direction as shown in FIG. 4*a* and for the fields aligned around the periphery as shown in FIG. 4*b*. Since the logs are rolling through the observations field 6, the data processing unit produces a plurality of signals corresponding to each measuring field which occurs in the form of pulses. These pulses form an image of each log in the data processing unit.

The data processing unit records the pulsed image signals which form a kind of finger print for each log. By retrieving the data at a later time, and comparing the recorded image with the log, an individual log can be identified.

In one form of the invention, the conveying surface is coated with a black material, such as a wear resistance plastic material. The black conveyor surface produces a sharp contrast to the logs and allows easy recognition of the brightness corresponding to the logs. The more intense brightness measurements of the logs followed by the low intensity measurements from the conveyor surface enables the data processing unit to easily determine the number of logs in a conveying field 24.

The signals corresponding to the brightness of each measuring field 12 arranged longitudinally and peripherally on the logs may be used to determine the amount of bark remaining on the logs, texture and defects in the wood. The longitudinal and peripheral fields of a log free of defects will produce a series of pulses of brightness measurement signals that are of substantially uniform intensity. The pulse signals will have a low frequency since the surface of each measuring field will be about the same. A log having blemishes or defects will produce a pulsed signal having a higher frequency since the defective areas will not have the same measured brightness as the unblemished areas and thus produce different brightness measurements around the different surfaces of the log.

Figure 5:
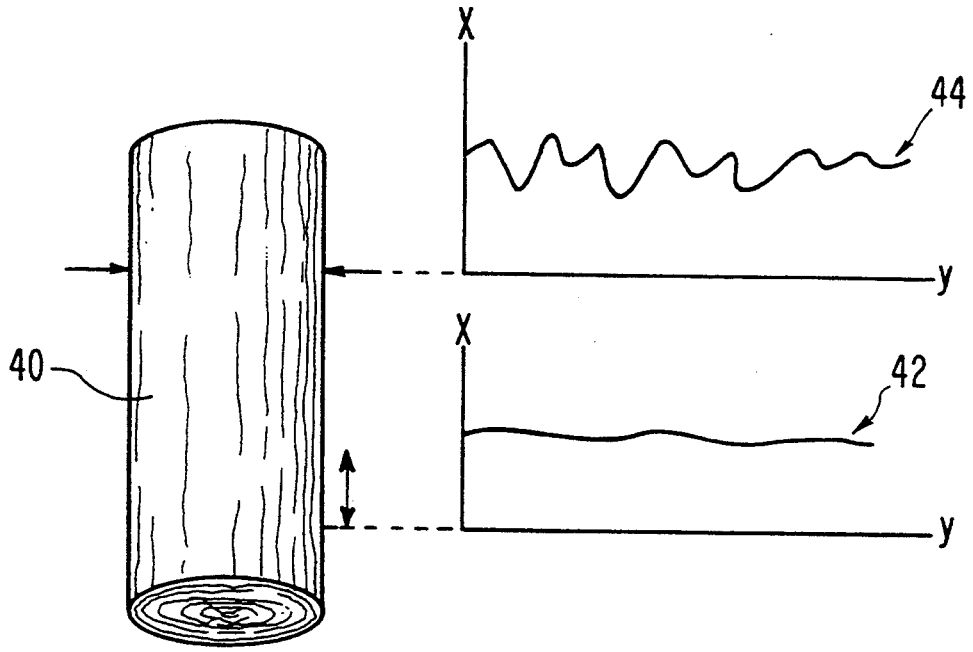
FIG. 5 is a schematic view of a graph of intensity of the brightness measurement (x) versus the position on the peripheral and longitudinal surface of the log (y)

The frequency of the pulse of the brightness may be used to detect defects in the logs and the types of defects. For example, as illustrated schematically in FIG. 5, a log having longitudinal cracks or splits 40 will produce substantially uniform brightness measurements 42 in the viewing fields arranged longitudinally, while the viewing fields arranged around the periphery will differ significantly and produce a high frequency pulsed measurement or signal 44. In the graphs of FIG. 5, (x) is the intensity of the brightness and (y) is the position of the measurement on the log in either the peripheral or longitudinal dimension.

The uneven surface of a log completely covered with bark will result in a low intensity brightness measurement due to the dark color. The surface irregularities of the bark will produce a high frequency pulse of the brightness of the viewing field in the peripheral and longitudinal directions. A dark colored log with the bark removed indicating rot or insect damage will produce a low intensity signal of relatively low frequency. Logs overlaying each other can be detected by the resulting shadows and the extreme differences in brightness measurements in the longitudinal and peripheral directions.

The camera 10 transmits a signal corresponding to each brightness measurement of each field 12 to the data processing unit 26. Each signal is then compared to a known value and produces a comparative value for each field. The data processing unit records each comparative value for the plurality of viewing fields on the logs and averages the comparative values for comparison with a known value. The logs are then classified according to the average comparative value.

The logs are separated by transmitting a signal from the data processing unit 26 to the sorting actuator 28 to direct the logs 8 to a desired location. The camera 10 and the data processing unit 26 having a recorded image of each log is able to recognize and detect each log 8 as it approaches the sorting apparatus. The actuator 28 via connection 34 operates the gate 7 so as to divert the logs 8 being discharged from the discharge end of conveyor 1 to the desired conveyor 4 or 5 in response to a signal from the data processing unit 26.

The camera in a preferred embodiment of the invention has sufficient resolution to measure a sufficient number of fields 12 to form an image of the logs as well as other surface characteristics. The image of each individual log may be stored in the data processing unit and retrieved to identify a log at a later time to direct the log to the desired location. The image of the logs may further be used to classify the logs by length, dimension or shape.

Figure 6:
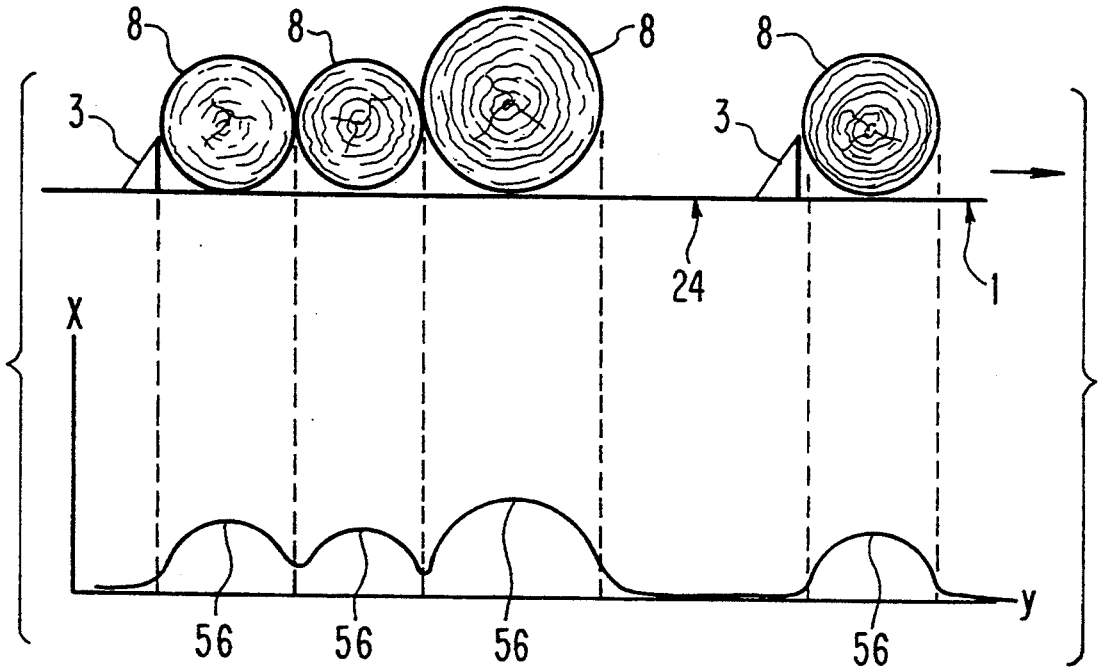
FIG. 6 is a graph of the distance measurement converted to thickness of the pieces of wood (x) versus the distance (y) the conveyor carries the wood through the viewing zone.

To assist in calculating the size of the logs, a distance detecting device 38 is positioned adjacent the camera to determine the distance from the camera to the uppermost surface of the log 8. This distance is transmitted to the data processing device by a line 40 to assist in the calculation of the dimension of the log. The distance detecting device is able to determine the number of logs in a conveying field. Each log 8 in the conveying field will produce a maximum measurement 56 as the log passes under the distance detector as illustrated schematically in FIG. 6. Typically, the number of maximum measurements 56 will correspond to the number of logs 8 in the carrier field 24. As shown in FIG. 6, the space between the peaks of the curve indicate the width of the logs and the number of logs in a conveyor field. The measurement may further be indicative of logs overlaying each other.

FIG. 2 represents an end view of the apparatus 18 and the discharge end of the conveyor belt 1 where discharge of the logs takes place. In the conventional procedure, an operator views the logs and operates a control device 9 to transmit a signal to a sorting apparatus for separating the pieces of wood into the discharge branches according to optical observation of observation field 6.

The position of cameras 10 are schematically illustrated in FIG. 2. The cameras serve to carry out the method according to the invention and is intended to replace the operators. FIG. 2 also shows a further advantage of the method according to the invention, namely the possibility to employ it with existing installations without requiring major changes in construction. Only framings for mounting the camera and, if required, the illumination means are necessary here.

The side view of the installation in FIG. 3 shows conveyor 1 with carriers or shovels 3. Furthermore, it illustrates the distribution of pieces of wood 8 to conveyors 4 and 5. By means of a control signal, the data processing means 26 and actuator 28 on the basis of the measuring data of cameras 10 in the device according to the invention, a hydraulic gate 7 is positioned in such a way that the logs drop on respective discharge conveyors 4 and 5. Distribution to several discharge conveyors can be carried out in a similar way. This figure especially shows the position of camera 10 and of illumination means 11 to illuminate and view the observation zone 6 on the logs. Normally there are several transporting fields formed by the carriers within observation zone 6. While being transported on the conveyor belt 1, the individual logs 8 roll around their longitudinal axis, which can also be promoted by known measures as, e.g., toothed racks or toothed fields in the observation zone 6.

FIGS. 4*a* and 4*b* represent the arrangement of the viewing fields 12 on logs 8. FIG. 4*b* shows the arrangement of viewing fields 12 around the periphery of log 8, while FIG. 4*a* shows the respective arrangement in longitudinal direction of logs 8. In order to avoid swinging out of the rigid rectangular observation window from the center of the logs in case the latter are in an oblique position, the complete observation window is made up of several smaller viewing fields 12 that follow each other in longitudinal direction of the log and may be arranged laterally displaced relative to each other. As both ends of the log are in most cases heavily split or damaged after passage through a bark peeling drum or other bark removing apparatus, the properties of the wood are no longer recognizable in these regions by the camera. To compensate for the possible inaccurate measurements of damaged areas, those parts of the log surface at the extreme ends are not taken into consideration for analysis and determination of the brightness value.

In case several logs are transported in one carrier field at the same time, these logs have to be logically separated from each other when being assessed by the scoring logic of the data processing means. By summing up the contour data of a complete log by the data processing unit 26, it is possible to locate, identify and remove defective logs. These data are recorded, memorized and compared throughout the whole observation period by the data processing unit 26, so as to ensure that the data of the individual pictures can always be attributed to the right objects.

In order to determine the bark content of each log, each individual picture point taken of the viewing fields is now compared to a predetermined adjustable bark threshold value and classified according to the amount of bark on the log. This procedure is repeated throughout the whole period of observation. Only after complete observation of the periphery of the log, the decision on bark or wood is made by comparison with a predetermined and adjustable limiting value for the overall degree of unbarking.

Although the invention has been described with a certain degree of particularity, it is understood that the present disclosure has been made only by way of example and that numerous changes in the details of construction and the combination and arrangement of parts may be resorted to without departing from the spirit and scope of the invention. Thus, the scope of the invention should not be limited by the foregoing specification, but rather, only by the scope of the claims appended hereto.

What is claimed is:

1. A method of separating a plurality of pieces of wood according to brightness and surface texture of said pieces of wood comprising:

conveying said pieces of wood through a viewing zone, illuminating said pieces of wood and measuring brightness and determining surface texture as a function of the intensity of reflected light of each piece of wood;

measuring said brightness in a plurality f measuring fields on each of said pieces of wood to obtain a plurality of measurements for each piece of wood;

averaging said plurality of measurements to obtain an average measured brightness;

comparing said average measured brightness with a known value; and separating said pieces of wood according to said averaged measured brightness and surface texture.

2. The method according to claim 1, further comprising comparing said brightness of each piece of wood with a known value to obtain a comparative value and classifying said pieces of wood according to said comparative value.

3. The method according to claim 1, comprising measuring said brightness to determine an amount of bark on said pieces of wood and separating pieces of wood having a predetermined amount of bark.

4. The method according to claim 3, further comprising discarding pieces of wood having a predetermined amount of bark.

5. The method according to claim 1, further comprising vertically illuminating the pieces of wood during said measuring step.

6. The method according to claim 1, further comprising measuring the brightness of logs contacting each other, and separating data corresponding to each log in a data processing unit.

7. The method according to claim 2, further comprising adjusting said known value in relation to differences in light intensity across said viewing zone.

8. The method according to claim 1, further comprising measuring said brightness of each of said pieces of wood to obtain a measurement and to determine the length, volume and shape of said pieces, comparing said measurement with a second known value corresponding to a desired length, volume and shape of said pieces of wood and producing a second value, and separating said pieces according to said second value.

9. The method according to claim 1, further comprising passing said pieces of wood through a first apparatus prior to or after measuring said brightness of said pieces, and adjusting the operation of said first apparatus in response to said brightness.

10. The method according to claim 1, further comprising producing a first signal responsive to said measured brightness, transmitting said signal to a data processing unit and producing a control signal in response to said first signal, transmitting said control signal to a separating device and activating said separating device in response to said control signal and separating said pieces.

11. The method according to claim 1, wherein said pieces of wood are a plurality of logs.

12. A method of separating a plurality of pieces of wood according to brightness and surface texture of said pieces of wood comprising:

conveying said pieces of wood through a viewing zone, illuminating said pieces of wood and measuring brightness and determining surface texture as a function of the intensity of reflected light of each piece of wood;

measuring said brightness in a plurality of measuring fields on each of said pieces of wood to obtain a plurality of measurements for each piece of wood;

averaging said plurality of measurements to obtain an average measured brightness;

comparing said average measured brightness with a known value;

rotating said pieces of wood during measurement of said brightness such that each of said plurality of measuring fields defines a different area on the surface of said piece of wood, said measuring fields being arranged in a longitudinal direction and a peripheral dimension of said wood; and separating said pieces of wood according to said brightness and surface texture.

13. An apparatus for separating pieces of wood comprising:

a first feed conveyor for carrying a plurality of pieces of wood having a longitudinal dimension;

a second conveyor receiving said pieces of wood from said first feed conveyor and conveying said pieces through a viewing zone, said pieces having said longitudinal dimension and being oriented on said second conveyor transverse to a direction of travel of said pieces;

said second conveyor comprising a rolling surface for rotating said pieces while being conveyed, said rolling surface comprising a black, wear-resistant surface of a plastic material;

camera means in said viewing zone for viewing at least one measuring field on said pieces and measuring brightness and texture of each of said pieces of wood as a function of the intensity of reflected light and producing a first signal responsive to a measured brightness, said camera means being capable of viewing a plurality of measuring fields on a peripheral and longitudinal dimension of said pieces while said pieces are rotating;

data processing means receiving said first signal and producing a control signal in response to said measured brightness and texture; and separating means receiving said control signal and being actuated by said control signal for selectively discharging said pieces of wood to one of at least two discharge conveyors.

14. A method of separating a plurality of pieces of wood according to brightness and surface texture of said pieces of wood comprising:

conveying said pieces of wood through a viewing zone, illuminating said pieces of wood and measuring brightness and determining surface texture as a function of the intensity of reflected light of each piece of wood;

said viewing zone including a rolling surface having a black wear-resistant surface; and separating said pieces of wood according to said brightness and surface texture.

15. A method of separating logs according to brightness of a surface of said logs comprising:

conveying and rotating said logs through a viewing zone;

said viewing zone including a rolling surface having a black wear-resistant surface;

illuminating said logs in said viewing zone;

measuring brightness of each of said logs by at least one camera means, said camera means producing a first signal responsive to said brightness as a function of the intensity of reflected light, and transmitting said first signal to data processing means;

comparing said first signal with a known value and producing a control signal in response to said comparison; and transmitting said control signal to a separating means and separating said logs in response to said control signal.

* * * * *